US006533068B1

(12) United States Patent
Reed

(10) Patent No.: US 6,533,068 B1
(45) Date of Patent: Mar. 18, 2003

(54) COMBINATION STEPLADDER AND EXTENSION LADDER

(75) Inventor: Robert Raymond Reed, Greer, SC (US)

(73) Assignee: Patent Consultants & Services, Inc., Greenville, SC (US)

( * ) Notice: Subject to any disclaimer, the term of this patent is extended or adjusted under 35 U.S.C. 154(b) by 0 days.

(21) Appl. No.: 09/953,768

(22) Filed: Sep. 17, 2001

(51) Int. Cl.[7] ..... E06C 1/00
(52) U.S. Cl. ..... 182/23; 182/209
(58) Field of Search ..... 182/23, 209, 25, 182/26

(56) References Cited

U.S. PATENT DOCUMENTS

| | | | | | |
|---|---|---|---|---|---|
| 1,351,146 | A | * | 8/1920 | Greeds | 182/209 |
| 1,935,349 | A | * | 11/1933 | Pierce | 182/178.4 |
| 2,639,853 | A | * | 5/1953 | Breslow | 182/108 |
| 3,146,852 | A | * | 9/1964 | Zerlini | 182/22 |
| 4,043,423 | A | | 8/1977 | Elias et al. | 182/22 |
| 5,638,918 | A | | 6/1997 | Hebda et al. | 182/151 |
| 5,836,595 | A | | 11/1998 | Brice | 280/30 |

OTHER PUBLICATIONS

"Multi–Use Ladder System" by Cosco a Wholly Owned Subsidiary of Dorel Ind. Inc Montreal CA.
"Adepta □ Ladders" by Cosco a Wholly–Owned Subsidiary of Dorel Industries Inc. Montreal.
"17 ' Multifunction Ladder" 2001 Spring Catalog of Sam's Wholsale Club, Greenville, SC.

* cited by examiner

*Primary Examiner*—Alvin Chin-Shue
(74) *Attorney, Agent, or Firm*—Robert R. Reed

(57) ABSTRACT

The combination ladder of this invention includes a pair of conventional ladder sections, being a first ladder section and a second ladder section. The two ladder sections being essentially the same. The ladder sections are connected together at one end with two upper connection assemblies and at the other end with two lower connection assemblies. Each connection assembly has a connector which are located in one of either a first position for providing a ladder configuration which allows the combination ladder to be used as an extension ladder or a second position for providing a ladder configuration which allows the combination ladder to be used as a stepladder. A pair of brace assemblies are stored along the first ladder section for the extension ladder and deployed for the stepladder. By simply moving the two upper connectors and the two lower connectors from the first position to the second position converts the configuration to conform with the intended use of the ladder.

17 Claims, 7 Drawing Sheets

Fig. 9
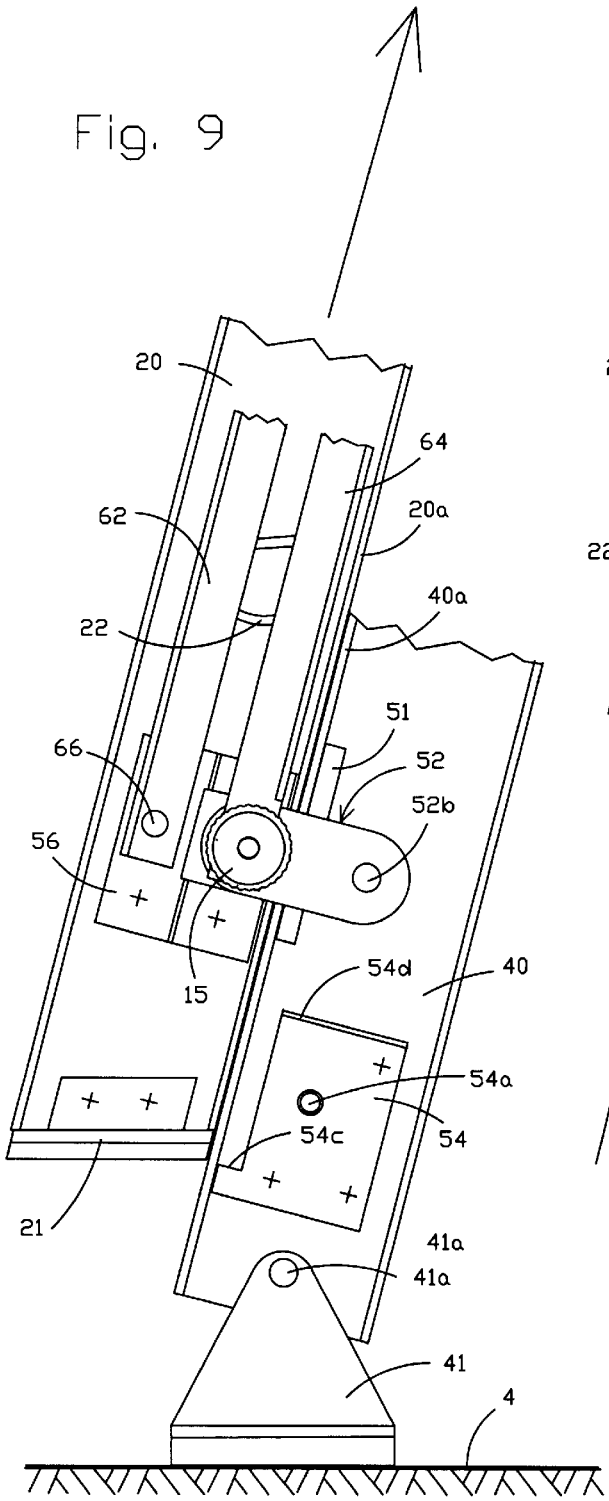
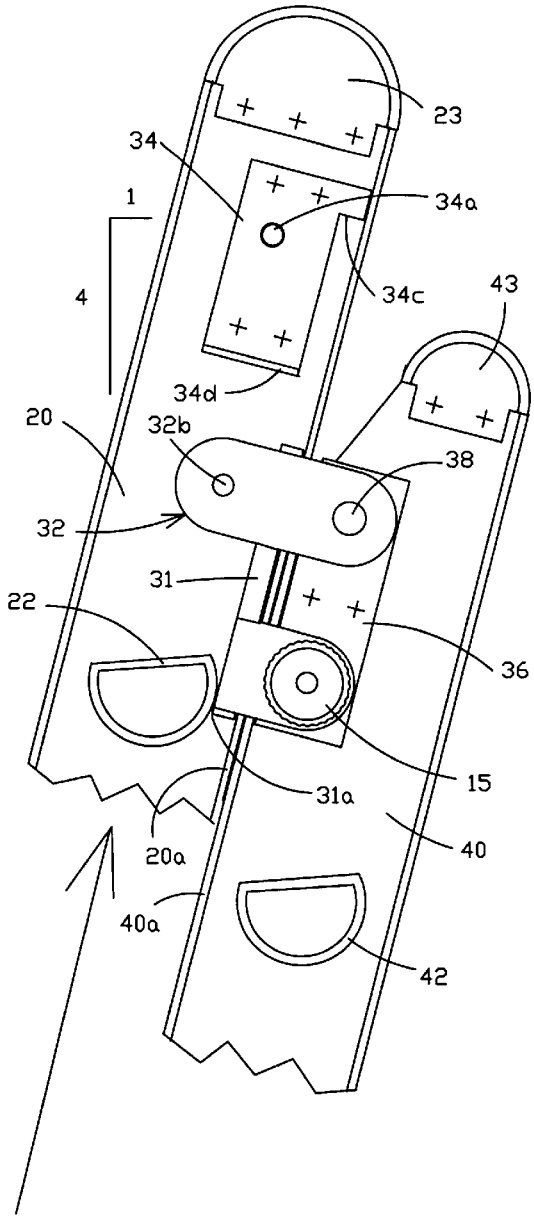
Fig. 10

COMBINATION STEPLADDER AND EXTENSION LADDER

BACKGROUND OF THE INVENTION

1. Field of the Invention

This invention is directed to conventional household ladders, and more particularly to a ladder that can be used as either a stepladder or an extension ladder.

2. Description of the Art

The household ladder has become an essential item around the house. The ladder is needed for gaining access to many areas. The roof areas as well as roof drains must be frequently inspected, cleaned and repaired. Some home owners also prefer to do their own painting and repair work on the exterior of the home. The ability of the homeowner to do these jobs has been made easier by the invent of new tools and equipment, such as economical paint sprayers. An extension ladder is generally used for this purpose and various other asks which require additional ladder length over the stepladder. The stepladder is needed where a vertical surface is not available to rest the upper end of the extension ladder. These tasks are more common to the interior of the house for painting, repair work, replacing light bulbs and the like. As a result, the needs for a ladder usually means the homeowner must purchase both a stepladder and an extension ladder to be able to safely perform all the required homeowner tasks. The homeowner needs a single ladder that can easily be converted from a stepladder to an extension ladder. The various jobs of a contractor also accent the needs for both a stepladder and an extension ladder. The contractor must transport from job to job both ladder types and ladders of different size to have the correct ladder at each job. The combination ladder of this invention provides the needs for both the homeowner and the contractor.

Stepladders have been converted into other tools commonly used by the homeowner or contractor. For example, the combination tool of U.S. Pat. No. 5,836,595 has a first position for providing a stepladder which is converted into a second configuration to become a handtruck. A number of conversion kits and multifunction ladders have been provided in the industry to address the needs of the homeowner and the contractor. Devices for converting an extension ladder into a step ladder are disclosed in U.S. Pat. Nos. 4,043,423 and 5,673,885. These devices include one or more support braces for holding the side rails of the extension ladder together to form an A-frame stepladder. Support braces are separate structural components that clamp or hold the side rails in the stepladder configuration. Therefore, the support braces as well as the paint tray are separate devices that must be stored until they are used to convert the extension ladder into a stepladder.

A "Multi-Use Ladder System" maketed by Cosco of Columbus, Ind. a subsidiary of Dorel Industries, Inc. of Montreal, Canada is sold by Sam's Club in their various wholesale outlet stores. This ladder has two extension ladder sections connected by a swivel device which allows the two ladder sections to either extend in a line with one another similar to an extension ladder or to form an A-fame shape to provide a stepladder. The swivel connecting device has a locked and an unlocket positions to move the ladder from one configuration to the other by rotating the two sections with respect to one another about the swivel device. This multi-use ladder is not a convention ladder with regard to how it operates or how it may be used. In addition, this ladder system does not appear to provide for braces when used as a stepladder.

The need remains to provide a combination extension ladder which easily converts into a stepladder as desired. The desire is to have an extension ladder and a stepladder which are somewhat conventional in the industry. There should be nothing new of different in either configuration that requires the user to adjust to what is standard and easily to use.

Accordingly, an object of the present invention is to provide a ladder that can easily be converted from a stepladder to an extension ladder and back to a stepladder as needed with little effort.

Another object of the present invention is to provide low cost connection assemblies that can be added to conventional ladder sections to provide the extension ladder or the stepladder with a paint tray and braces.

Yet another object of the present invention is to provide a single ladder for multiple use around the house without the need to have two ladders.

Still another object of the present invention is to provide a combination ladder with the safety, strength and durability of the conventional stepladder and the conventional extension ladder.

SUMMARY OF THE INVENTION

The above objectives are accomplished according to the present invention by providing a combination ladder which can easily be converted to provide either an extension ladder configuration or a stepladder configuration. First and second ladder sections are used which are generally conventional in the industry with side rails and rungs between the side rails. The ladder sections are generally of the same size and the flanges of the side rails are placed adjacent to one another. A pair of upper connection assemblies are provided at the top ends of the side rails and a pair of lower connection assemblies are provided at the lower ends of the side rails. Each connection assembly has a connector that is changed from a first position to a second position to convert the ladder from one configuration to the other configuration. A pair of brace assemblies provide a lateral brace for the stepladder. A paint shelf can also be provided for use with either ladder configuration.

In one embodiment of the invention a combination ladder is provided including first and second conventional ladder sections each having upper and lower ends alternately connected together to provide a stepladder configuration or an extension ladder configuration. The combination ladder comprises a pair of upper connection assemblies for connecting the upper ends of the ladder sections together. Each upper connection assembly includes an upper slide unit, an upper support plate, an upper stop plate, a hinge pin and an upper connector for connecting the upper slide unit to either one of the upper support plate or the upper stop plate. A pair of lower connection assemblies connect the lower ends of the ladder sections together. Each lower connection assembly including a lower slide unit, a lower support plate, a lower stop plate and a lower connector for connecting the lower slide unit to either one of the lower support plate or the lower stop plate. The upper and lower connectors have a first position for attaching both upper slide units to a respective upper support plate and both lower slide units to a respective lower support plate. The first ladder section is free to move parallel to the second ladder section to provide the extension ladder configuration. The upper and lower connectors have a second position for attaching both upper slide units to a respective upper stop plate and both lower slide units to a respective lower stop plate. Therefore, the upper end of the first ladder section is rotateably attached to the upper end of the second ladder section and the lower end of the first ladder section is free to move transverse to the lower end of the second ladder section to provide the stepladder configuration.

In a second embodiment of the invention a ladder assembly provides either one of a stepladder or an extension ladder. The ladder assembly comprises first and second conventional ladder sections each having a pair of side rails with upper and lower ends and evenly spaced apart rungs extending between said each pair of side rails. A pair of upper connection assemblies are associated with the upper ends of the side rails. The upper connection assemblies each have an upper slide unit for holding the side rails of the first and second ladder sections adjacent one to the other, so that the first ladder section can be displaced relative to the second ladder section. A pair of lower connection assemblies are associated with the lower ends of said side rails. The lower connection assemblies each have a lower slide unit in combination with a pair of brace assemblies for holding the lower ends of the side rails of the ladder sections in a predetermined location one to the other. A pair of upper connectors of the upper connection assemblies and a pair of lower connectors of the lower connection assemblies are provided. Therefore, a first position of the connectors provides the extension ladder and a second position of the connectors provides the stepladder.

In another aspect of the invention the upper and lower slide units of the connector assemblies each include at least one connector plate and a slide plate affixed to the connector plate. Each connector attaches the connector plate to the support plate so that the ladder sections are held in position between the lower slide plate and the lower support plate to provide the extension ladder configuration. Alternately, each connector attaches the connector plate to the stop plate so that the ladder sections can rotate with respect to one another about a hinge pin to provide the stepladder configuration.

In a further embodiment of the invention the combination ladder includes a pair of brace assemblies for connecting the lower end of the first ladder section to the lower end of the second ladder section. Therefore, the transverse distance between the lower ends of the ladder sections is limited by the pair of brace assemblies when providing the stepladder configuration.

In another embodiment of the invention a method provides one of either a stepladder or an extension ladder. The method includes the first step of providing first and second conventional ladder sections. Each ladder section has a pair of side rails with upper ends and lower ends. A second step includes placing the ladder sections adjacent one to the other so that the side rails are aligned with each other, being one above the other. A third step includes providing a pair of upper connection assemblies associated with the upper ends of the ladder sections and a pair of lower connection assemblies associated with the lower ends of the ladder sections. The method includes a fourth step of affixing a support plate of the upper connection assemblies to each one of the side rails at the upper end of the second ladder section and a support plate of the lower connection assemblies to each one of the side rails at the lower end of the first ladder section. The method includes a fifth step of affixing a stop plate of the upper connection assemblies to each one of the side rails at the upper end of the first ladder section and a stop plate of the lower connection assemblies to each one of the side rails at the upper end of the second ladder section. In a sixth step the method provides an upper slide unit and an upper connector for each one of the upper connection assemblies and a lower slide unit and a lower connector for each one of the lower connection assemblies. A seventh step includes connecting either one of the slide units to the stop plates using the connectors to provide the stepladder, or the slide units to the support plates using the connectors to provide the extension ladder.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 9 is a side elevation view of the lower end of the combination ladder operating as an extension ladder and illustrating the first ladder section displaced parallel to the second ladder section which is resting on a supporting surface;

FIG. 10 is a side elevation view of the upper end of the combination ladder operating as an extension ladder and illustrating the first ladder section displaced parallel to the second ladder section;

DESCRIPTION OF A PREFERRED EMBODIMENT

Referring now in more detail to the drawings, the invention will now be described in more detail. The combination ladder of this invention includes a pair of conventional ladder sections, being a first ladder section and a second ladder section. The two ladder sections are essentially the same. The ladder sections are connected together at one end with two upper connection assemblies and at the other end with two lower connection assemblies. Each connection assembly has a connector which is either located in a first position for providing a ladder configuration which allows the combination ladder to be used as an extension ladder, or in a second position which allows the combination ladder to be used as a stepladder. By simply moving the two upper connectors and the two lower connectors from the first position to the second position converts the configuration and intended use of the ladder.

Figure 1A:
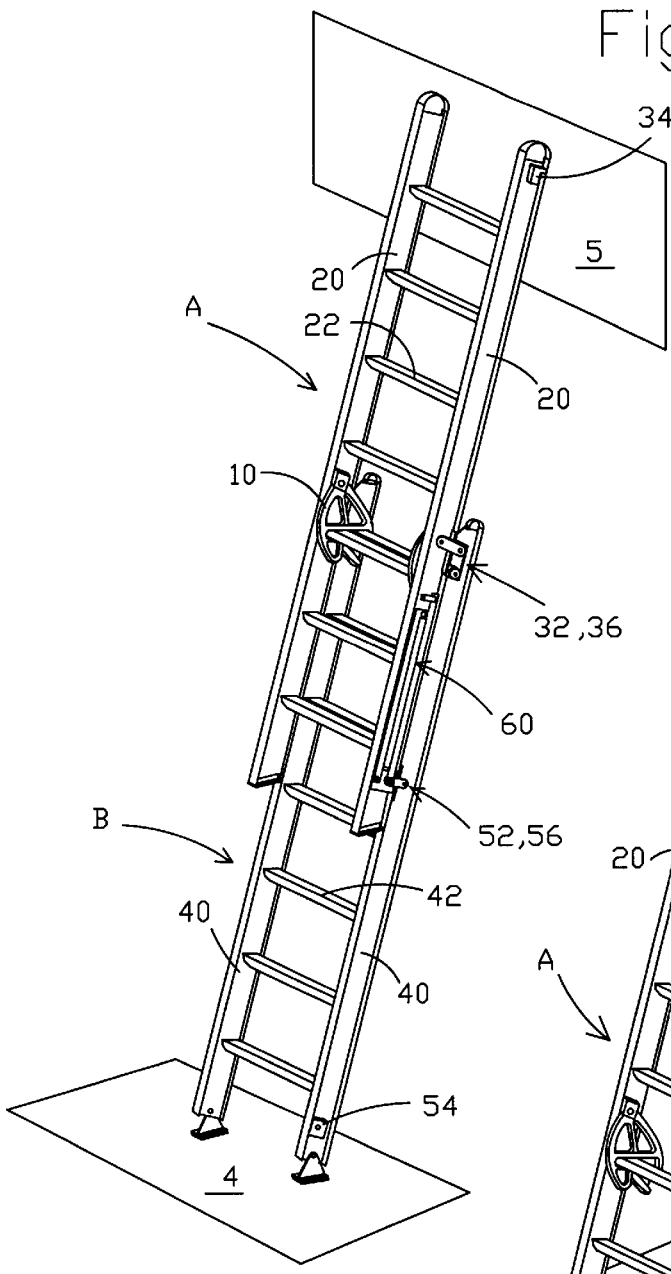
FIG. 1A is a perspective view of a combination ladder of this invention having been converted to an extension ladder and placed in a position for accessing objects placed at a relatively high location.
Figure 1B:
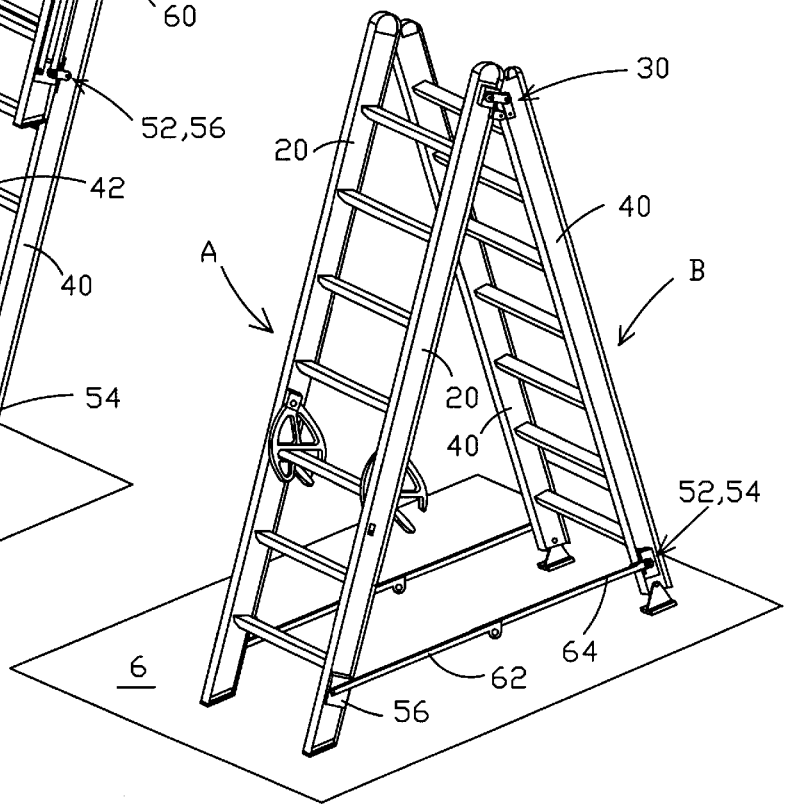
FIG. 1B is a perspective view of a combination ladder of this invention having been converted to a stepladder and placed in position on a generally horizontal supporting surface for accessing objects.

In the two configurations illustrated in FIGS. 1A and 1B, the combination ladder is shown as an extension ladder (FIG. 1A) and a stepladder (FIG. 1B). For the extension ladder of FIG. 1A, first ladder section A extends above second ladder section B. The conventional ladder sections have side rails 20 and 40 and interconnecting equally spaced apart rails 22 and 42. The ladder sections are held together by an upper slide unit 32 and support plate 36 attached to ladder section B and a lower slide unit 52 and support plate 56 attached to ladder section A. Ladder section A is vertically supported from ladder section B by conventional extension supports 10. When the ladder is collapsed to its smallest length, stop plates 34 and 54, attached to respective ladder sections, keep the ladder sections from coming apart. A brace assembly 60 is carried on both lateral sides of the upper ladder section for future use with the stepladder. At the lower end of the extension ladder, ladder section B is placed on supporting surface 4, and at the upper end of the extension ladder, ladder section A rests on a vertical support 5.

For the stepladder of FIG. 1B, ladder section A and B form an A-frame configuration. The ladder sections are connected at their upper ends by an upper connection assembly 30 and at their lower ends by first and second support braces 62 and 64 on each lateral side of the ladder. Each support brace is attached at one end to the lower support plate 56 attached to ladder section A and at the other end to the lower stop plate 54 attached to ladder section B. Connection assembly 30 is hinged to allow the two ladder section to rotate with respect to one another about the upper end of the stepladder. The stepladder is supported by supporting surface 6 which is generally horizontal.

Figure 2A:
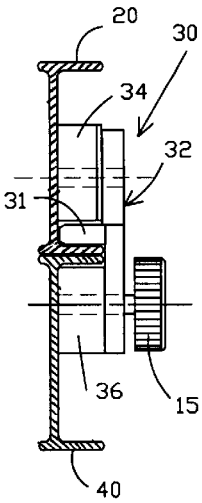
FIG. 2A is a cross sectional view taken along line 2A—2A in FIG. 2.
Figure 2:
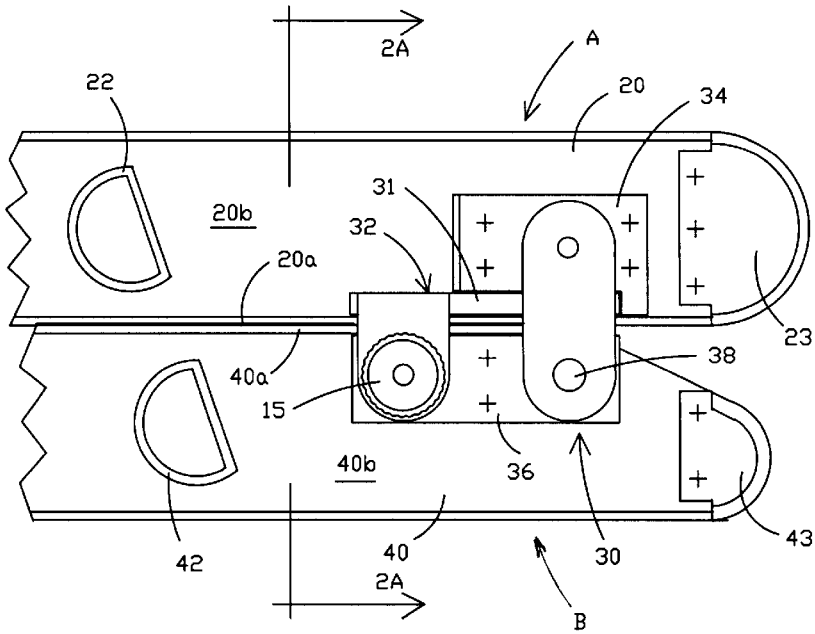
FIG. 2 is a side elevation view of the upper end of the combination ladder showing an upper connection assembly attached to the upper ends of both ladder sections with an upper connector in the extension ladder configuration.
Figure 3:
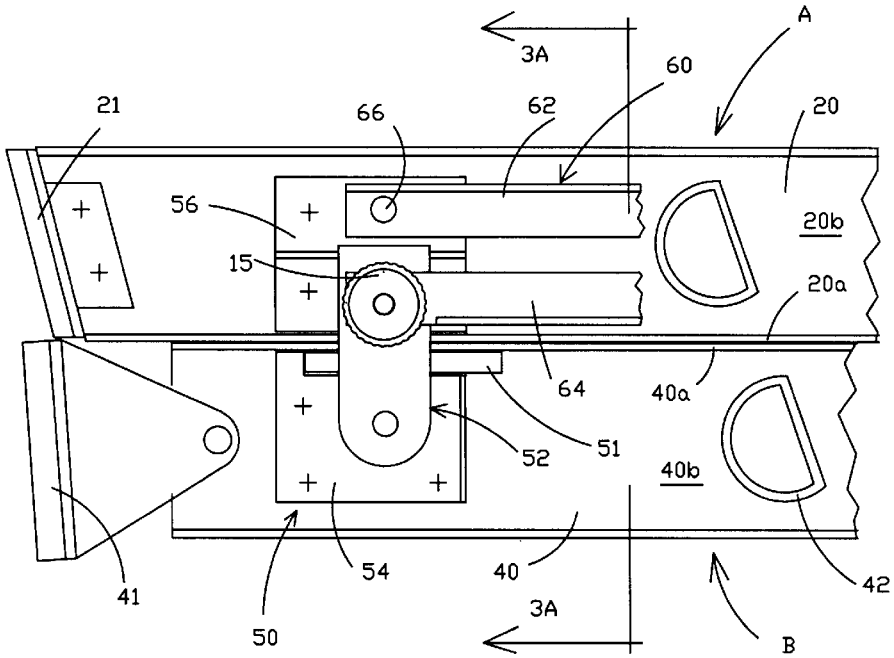
FIG. 3 is a side elevation view of the lower end of the combination ladder showing a lower connection assembly attached to the lower ends of both ladder sections with a lower connector in the extension ladder configuration.

The upper and lower connection assemblies are disclosed in more detail by referring to FIGS. 2 and 3. A side elevation view of an upper connection assembly 30 connected to the upper ends of the first and second ladder sections A and B is illustrated in FIG. 2. Only one side of the combination ladder is illustrated, with the other side having essentially the same connection assembly 30. An upper stop plate 34 is affixed to the upper end of the first side rail of first ladder section A. An upper support plate 36 is affixed to the upper end of the second ladder section B. An upper slide unit 32 is connected by a hinge pin to the upper support plate so it can rotate with respect to the support plate. In addition, an upper connector 15 also attaches the upper slide unit to the support plate for the extension ladder configuration. For this configuration, the upper slide unit is free to move to the right with respect to the stop plate. An upper slide plate 31 of the upper slide unit keeps the two ladder sections A and B aligned adjacent one to the other, as required for an extension ladder. The upper slide plate passes the end of the rungs 22 of the first ladder as ladder section A moves to the right with respect to ladder section B.

The cross-sectional view of FIG. 2A illustrates the relative location and size of upper stop plate 34, upper support plate 36, upper slide plate 31 of the upper slide unit 32 and the upper connector 15 for the upper connection assembly 30. The first and second ladder sections are essentially the same size and configuration for the combination ladder of this invention. First ladder section A has side rails 20 with a first flange portion 20*a* and a first web portion 20*b*. Second ladder section B has side rails 40 with a second flange portion 40*a* and a second web portion 40*b*. The support plate 36 is affixed to the second web portion and the flanges 20*a* and 20*b* are retained between slide plate 31 and support plate 36 for this extension ladder configuration. Upper end caps 23 and 43 are provided for the first and second ladder sections respectively.

A side elevation view of a lower connection assembly 50, connected to the lower ends of the first and second ladder sections A and B, is illustrated in FIG. 3. Only one side of the combination ladder is illustrated, with the other side having essentially the same connection assembly 50. A lower stop plate 54 is affixed to the lower end of the second side rail 40 of second ladder section B. A lower support plate 56 is affixed to the lower end of the first side rail 20 of the first ladder section A. An lower slide unit 52 is connected by a lower connector 15 to the support plate for the extension ladder configuration. For this configuration, the lower slide unit is free to move to the right with respect to the lower stop plate. A lower slide plate 51 of the lower slide unit keeps the two ladder sections A and B aligned adjacent one to the other, as required for an extension ladder. The lower slide plate passes the end of the rungs 42 of the second ladder section as first ladder section A moves to the right with respect to second ladder section B.

Figure 3A:
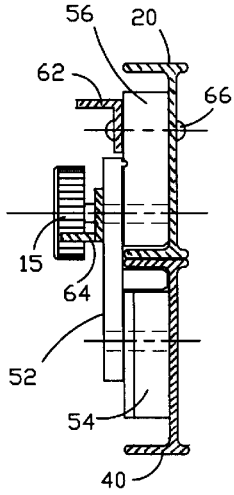
FIG. 3A is a cross sectional view taken along line 3A—3A in FIG. 3.

The cross-sectional view of FIG. 3A illustrates the relative location and size of lower stop plate 54, lower support plate 56, lower slide plate 51 of the lower slide unit 52 and the lower connector 15 for the complete lower connection assembly 50. As previously disclosed, first ladder section A has side rails 20 with a first flange portion 20*a* and a first web portion 20*b* and second ladder section B has side rails 40 with a second flange portion 40*a* and a second web portion 40*b*. The support plate 56 is affixed to first web portion 20*b* and the flanges 20*a* and 40*a* are retained between slide plate 51 and support plate 56 for this extension ladder configuration. Foot pads 21 and 41 are provided for the lower ends of side rails 20 and 40 respectively, as illustrated in FIG. 3. The foot pad 41 helps support the ladder on supporting surface 5 (FIG. 1A).

Each one of the four connector 15 can be used in any one of the eight locations in this invention. One set of four locations provides the extension ladder, described above, and the other set of four locations provides the stepladder, as described below. The connectors are made with a knob portion so that the screw portion can be tightened by hand in the threaded hole of either the stop plate or the support plate, depending on the desired ladder configuration. Alternately, a connector can have a handle so that twisting the handle removes or places the screw portion in a respective threaded hole. In addition, within the scope of this invention, the connectors can be a spring loaded U-shape connector attached to the ladder section which is rotated and placed into the proper hole of the plates to provide the desired ladder configuration. However, the connector should have a clamping action when connecting portions of connection assemblies 30 and 50 together.

Conventional ladder sections A and B are made of a material being either a metal, such as aluminum, or a reinforced plastic, such as fiberglass. Rungs 22 and 42 are generally made of a metal and penetrate the side rails with end collars to hold the rungs attached to the side rails. The end caps and foot pads are of a metal and/or a plastic material to stabilize the ladder sections as they come into contact with the supporting surfaces of the combination ladder.

Figure 4:
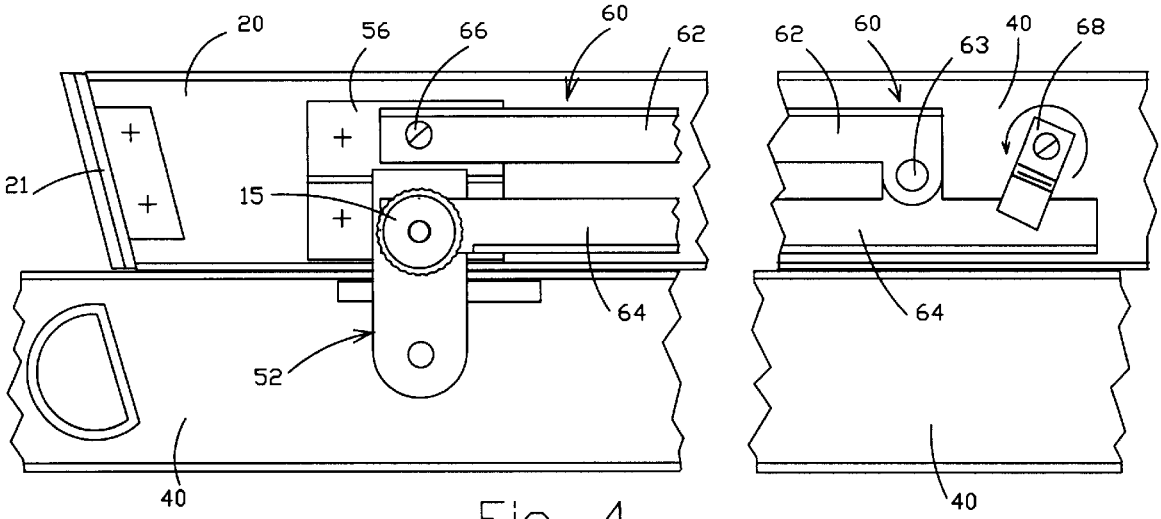
FIG. 4 is a side elevation view of a portion of the combination ladder showing the first ladder section being displaced parallel to the second ladder section as typically done with the extension ladder.

A brace assembly 60 must be provided on both sides of the combination ladder for the stepladder configuration of this invention. The brace assembly is not required when the extension ladder configuration is being used. Therefore, the brace assembly must be removed or temporarily stored until needed. Each brace assembly in this invention is carried by first ladder section A when the extension ladder configuration is in use. The stored location of brace assembly 60 is illustrated in FIG. 4. A first support brace 62 of the brace assembly is attached at one end to lower support plate 56 using a brace pin 66. A second support brace 64 is connected at one end to the lower support plate using lower connector 15. The lower connector also connects the lower slide unit 52 to the lower support plate at the same time. The other ends of first and second support braces 62 and 64 are connected by a center pin 68. A brace clip 68, rotateably attached to the first ladder section, is rotated to contact the second support brace and keep the brace assembly stored along the web portion of side rail 20 of first ladder section A.

Figure 5:
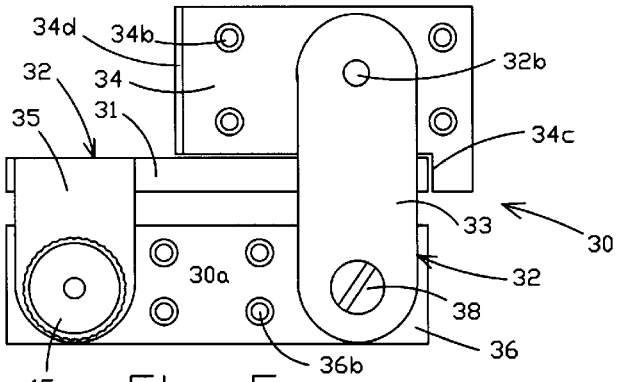
FIG. 5 is a side elevation view of the upper connection assembly in the extension ladder configuration.
Figure 6:
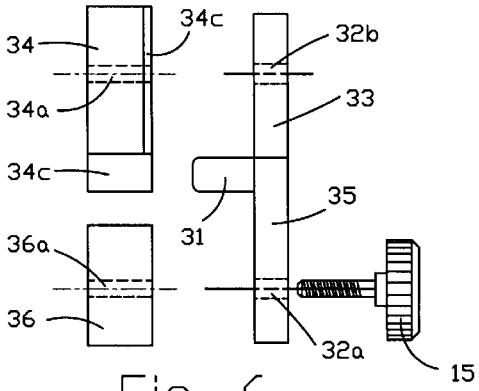
FIG. 6 is an exploded end elevation view of the upper connection assembly of FIG. 5.

The connection assemblies are disclosed in more detail by referring to the illustrations of FIGS. 5–8. Upper connection assembly 30 is shown in FIGS. 5 and 6. Again, a pair of upper connection assemblies are required. The two upper connection assemblies are mirror images of one another for placement on the two lateral sides of the side rails for connecting together the upper ends of the two ladder sections. Only one of the pair of assemblies is discussed in this section. Four structural components comprise each upper connection assembly. These include upper slide unit 32, upper stop plate 34, upper support plate 36 and upper connector 15. The upper stop plate is affixed to first ladder section A by a suitable means; such as fasteners 34*b* or by welding. The upper support plate is affixed to second ladder section B by a suitable means; such as fasteners 36*b* or by welding. Upper slide unit 32 is rotateably attached to the support plate and the second ladder section by a hinge pin 38. The upper connector 15 is used to either connect slide unit 32 to the upper stop plate or the upper support plate, depending on what ladder configuration is desired. The upper connector is shown connecting the slide unit to the support plate for the extension ladder configuration. Moving upper connector 15 to opening 32*b* in the upper slide unit converts the upper connection assembly to provide the stepladder configuration.

The components of upper connection assembly 30 that comprise upper slide unit 32 include a first connector plate 33 a second connector plate 35 and an upper slide plate 31, as illustrated by the exploded view of FIG. 6. The upper slide plate is affixed to the connector plates by a suitable means, such as fasteners or by welding. Upper connector 15 is inserted through hole 32*a* of the second connector plate into threaded hole 36*a* of the upper support plate for the extension ladder configuration. The slide plate is in contact with the stop plate at interface 34*c* for this configuration (FIG. 5). The upper stop plate has a chamfered edge 34*d* to assist first connector plate 33 in moving past this edge. A connection space 30*a* between slide plate 31 and upper support plate 36 receives and holds the first and second side rails together, as previously discussed. Alternately, the upper connector is inserted through hole 32*b* of the first connector plate into threaded hole 34*a* of the upper stop plate for the stepladder configuration. The upper slide unit along with the upper stop plate rotates about hinge pin 38 for this configuration.

Figure 7:
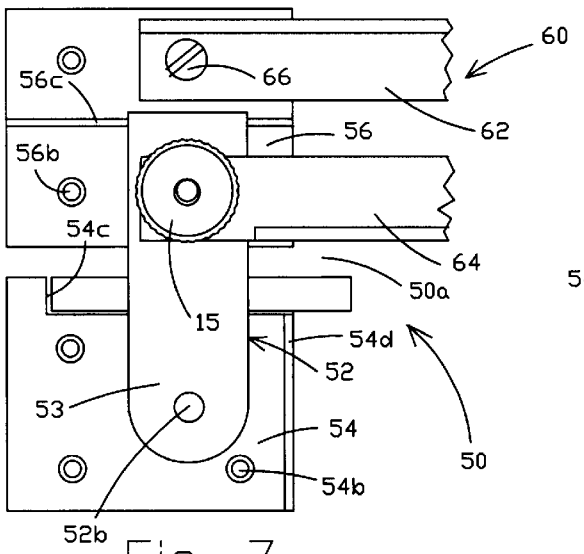
FIG. 7 is a side elevation view of the lower connection assembly in the extension ladder configuration.
Figure 8:
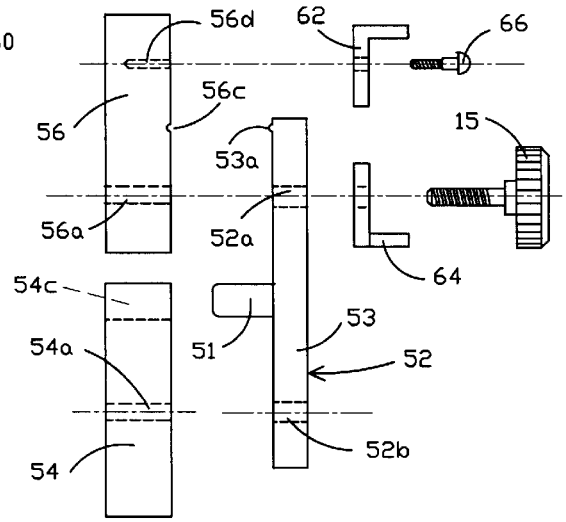
FIG. 8 is an exploded end elevation view of the lower connection assembly of FIG. 7.

Lower connection assembly 50 is shown in FIGS. 7 and 8. Again, a pair of lower connection assemblies are required. The two lower connection assemblies are mirror images of one another for placement on the two lateral sides of the side rails for connecting the lower ends of the two ladder sections. Only one of the pair of lower assemblies is discussed in this section. Four structural components comprise each lower connection assembly. These include lower slide unit 52, lower stop plate 54, lower support plate 56 and lower connector 15. The lower connector is essentially the same as the upper connector to be interchangeable. The lower stop plate is affixed to second ladder section B by a suitable means; such as fasteners 54*b* or by welding. The lower support plate is affixed to first ladder section A by any suitable means; such as fasteners 56*b* or by welding. A brace assembly 60 is also provided with each lower connection assembly, as disclosed above (See FIG. 4). Again, one end of a first support brace 62 of the brace assembly is rotateably attached to the lower support plate. The lower connector 15 is used to either connect lower slide unit 52 to the lower stop plate or the lower support plate, depending on what ladder configuration is desired. The lower connector is shown connecting the lower slide unit and a second support brace 64 of the brace assembly to lower support plate 56 using threaded hole 56*a* for the extension ladder configuration. Moving lower connector 15 along with second support brace 64, so that the lower connector extends through opening 52*b* in the lower slide unit into threaded opening 54*a* of the lower stop plate, converts the lower connection assembly to provide the stepladder configuration.

The components of lower connection assembly 50 that comprise lower slide unit 52 include a lower connector plate 53 and a lower slide plate 51, as illustrated by the exploded view of FIG. 8. The lower slide plate is affixed to the lower connector plate by a suitable means, such as fasteners or by welding. Lower connector 15 is inserted through hole 52*a* of the lower connector plate and the hole in second support brace 64 into threaded hole 56*a* of the upper support plate for the extension ladder configuration. A connection space 50*a* between lower slide plate 51 and lower support plate 56 holds the first and second ladder sections together, as previously discussed. A cutout 56*c* of the lower stop plate receives a ridge 53*a* of the lower slide unit to maintain the width of the connection space and stabilize the lower slide unit from any rotational movement. The lower slide plate is placed in contact with the lower stop plate at interface 54*c* for inserting lower connector 15 into threaded hole 56*a*. The lower stop plate has a chamfered edge 54*d* to assist the lower connector plate in moving past this edge. Alternately, the lower connector is inserted through hole 52*b* of the lower connector plate and the same hole in the second support brace into threaded hole 54*a* of the lower stop plate for the stepladder configuration. The lower ends of the ladder sections can move apart to the extent of the total length of the first and second support braces as the ladder sections rotate about hinge pin 38 at the upper ends.

The operation of the extension ladder of this invention, as illustrated in FIG. 1A, is disclosed in more detail by referring to the illustrations of FIGS. 9 and 10. The lower ends of first and second ladder sections are shown in the side elevation view of FIG. 9 and the upper ends of the extension ladder sections are shown in the side elevation view of FIG. 10. Elevation views of the other side of the extension ladder are a mirror image of the views shown. The following discussion of the side illustrated also applies to the opposite side, not shown. Lower stop plate 54 remains affixed at the lower end of the second side rail. The first side rail 20 is free to move in a direction parallel to second side rail 40, as illustrated by the arrow. Lower support plate 56 affixed to first side rail 20 carries slide unit 52 as it moves upward; as a result of the lower connector being in a position to attach the lower slide unit to the lower support plate. The flange 20*a* of the first side rail and the flange 40*a* of the second side rail are retained between the lower slide plate 51 and lower support plate 56 as the ladder sections move parallel to one another. The second ladder section includes a foot pad 41 rotateably attached by a foot pad pin 41*a* to the lower end of second side rail 40. The foot pad adjusts to the slope of supporting surface 5 to support the extension ladder. Brace assembly 60 with first and second support braces 62, 64 are not required for the extension ladder. The brace assembly is carried or stored by first side rail 20 to move with the first side rail for the configuration of the extension ladder.

The upper end of the extension ladder of FIG. 10 illustrates the movement of first side rail 20 upward with respect to the second side rail 40, as shown by the arrow. Upper slide unit 32 is attached to upper support plate 36 by upper connector 15 for this extension ladder configuration. Stop plate 34 remains affixed to the upper end of the first side rail as first and second side rails move parallel to one another. The flange 20*a* of the first side rail and the flange 40*a* of the second side rail are retained between the upper slide plate 31 and upper support plate 36 as the ladder sections move parallel to one another. The combination of the upper restraint of the first and second side rails and the lower restraint of the first and second side rails by the connection assemblies allows the combination ladder to function as a conventional extension ladder in the industry. A critical clearance between rungs 22 of the first side rails and the edge 31*a* of upper slide plate 31 must be maintained so the upper slide plate clears the rungs as the extension ladder is extended. The same clearance must be maintained for lower slide plate 51 as it passes rungs 42 of the second ladder section. Rail caps 23 and 43 provide protection for resting the upper end of either the first ladder section or the second ladder section on vertical support 5 (FIG. 1A). A short extension will cause cap 43 to support the upper end of the extension ladder and a longer extension will cause cap 23 to provide the upper end support.

Figure 11:
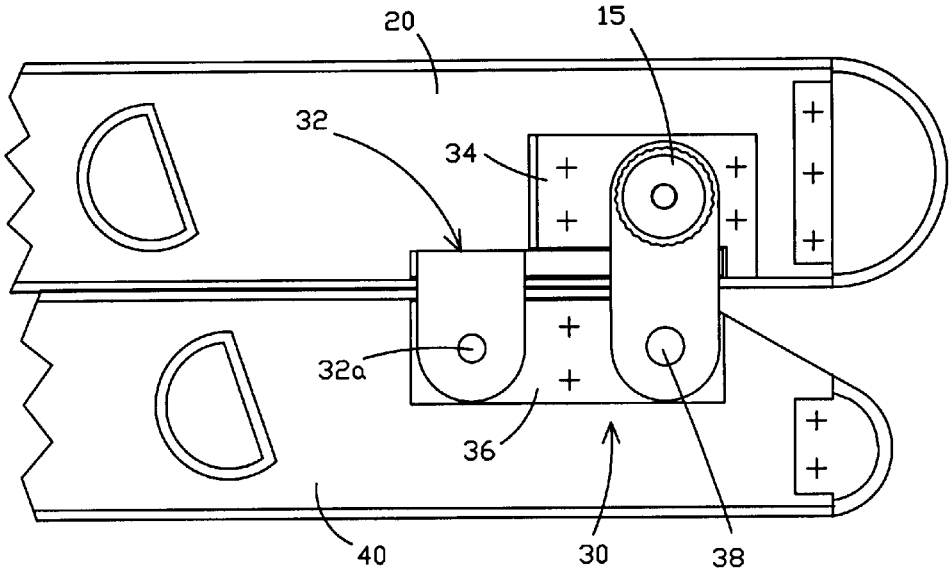
FIG. 11 is a side elevation view of the upper end of the combination ladder showing the upper connection assembly attached to the upper ends of both ladder sections with the upper connector in the stepladder configuration.
Figure 12:
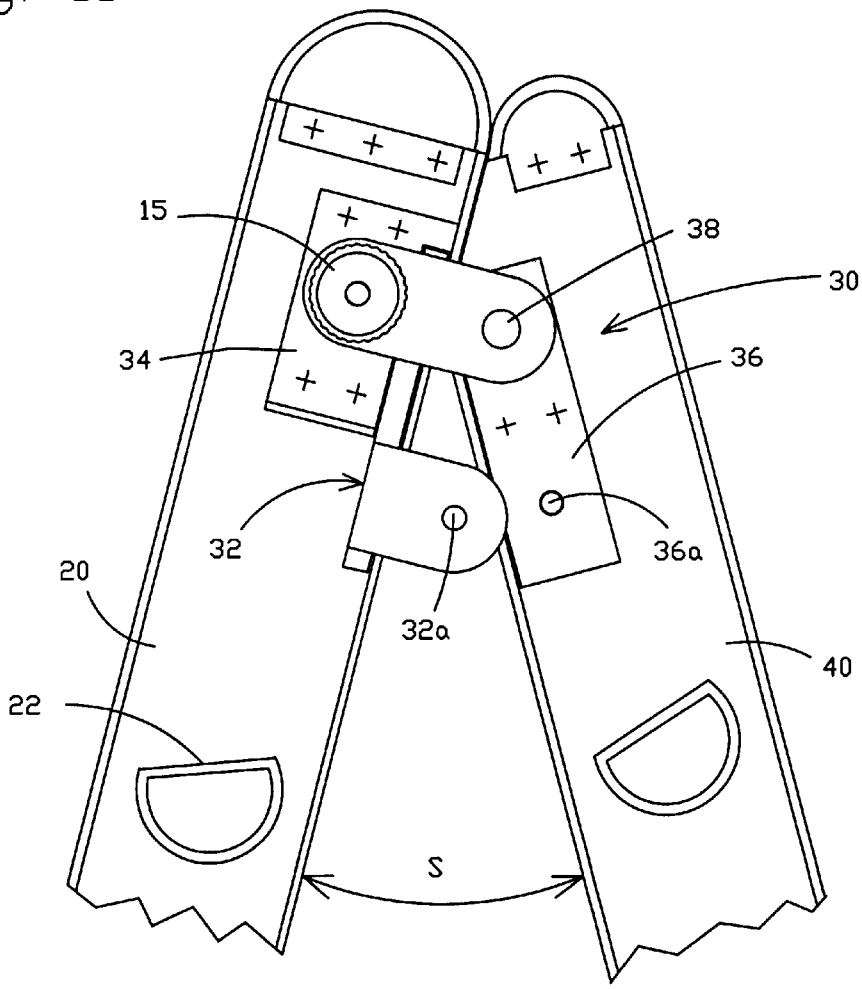
FIG. 12 is a side elevation view of the upper end of the combination ladder of FIG. 11 placed in a vertical position with the first ladder section rotated with respect to the second ladder section to provide an upper end of the stepladder.

The configuration of upper connection assembly 30 at the upper ends of the ladder sections to obtain a stepladder is illustrated in the side elevation views of FIGS. 11 and 12. Elevation views of the other side of the stepladder are mirror images of the views shown. The following discussion of the side shown also applies to the opposite side, not shown. A first step in the conversion is to relocate the upper connector 15 from hole 32*a* of the slide unit 32 to attach the slide unit 32 to the stop plate 34, as illustrated in FIG. 11. The connection assembly is now in a configuration to allow first and second side rails 20 and 40 to rotate relative to one another about hinge pin 38. The ladder sections are turned to a generally vertical position and one ladder section is rotated with respect to the other in FIG. 12. The slide unit is carried along with first side rail 20. Rungs 22 of the first ladder section maintain a horizontal surface for climbing the stepladder. The upper end of the second side rail is beveled to allow the ladder sections to reach an angle S with respect to one another.

Figure 13:
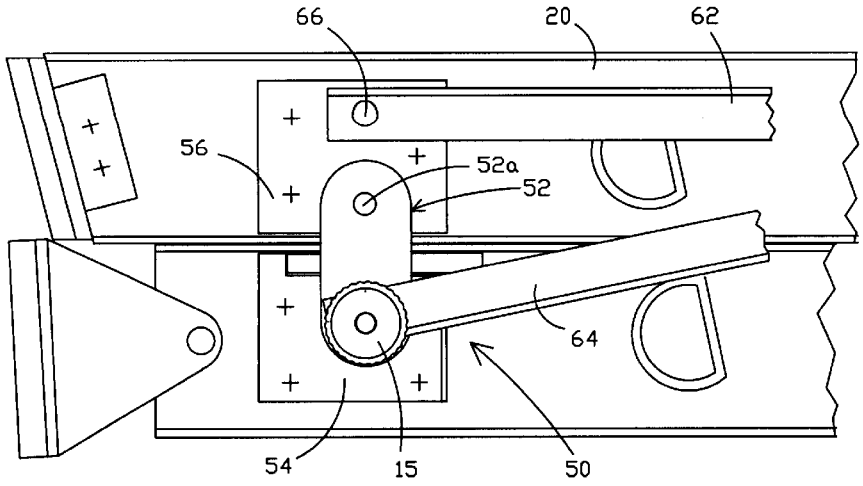
FIG. 13 is a side elevation view of the lower end of the combination ladder showing the lower connection assembly attached to the lower ends of both ladder sections with the connector in the stepladder configuration.
Figure 14:
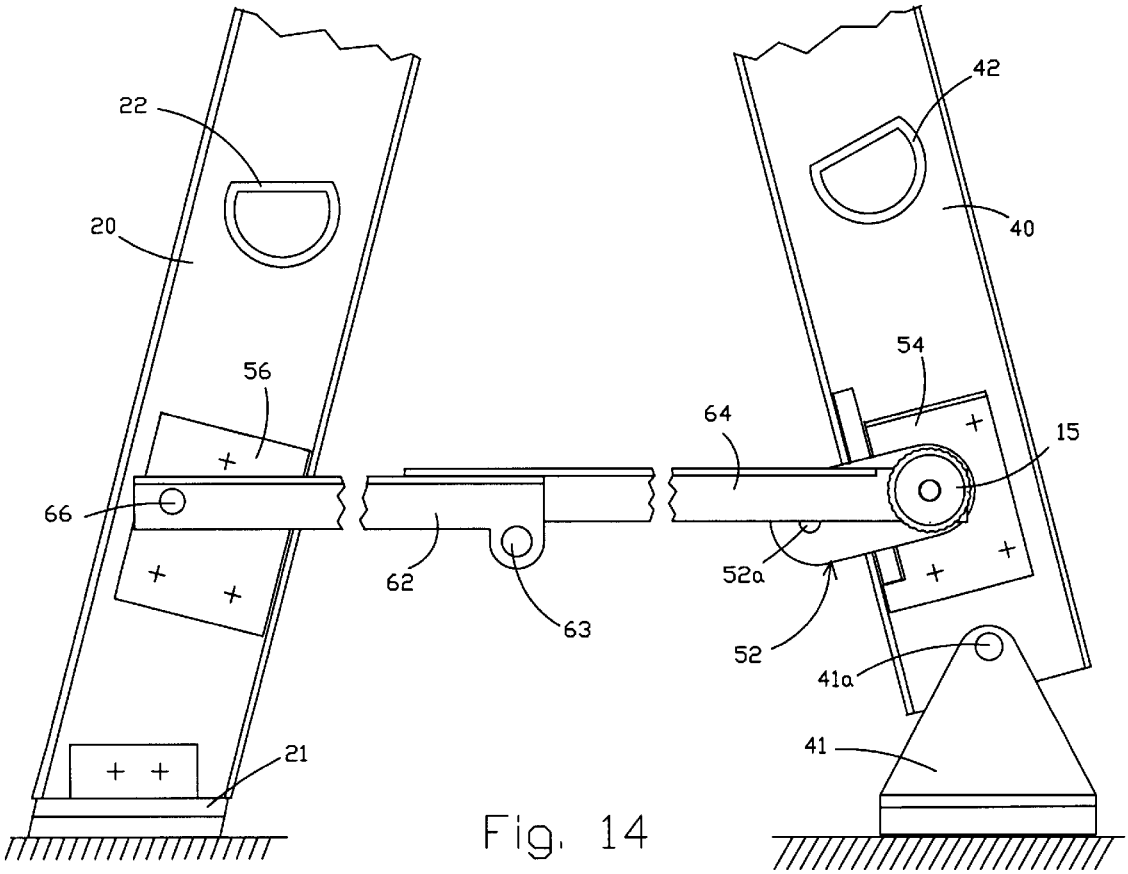
FIG. 14 is a side elevation view of the lower end of the combination ladder of FIG. 13 placed in a vertical position with the first ladder sections displaced horizontally with respect to the second ladder section to provide a lower end of the stepladder held together by a brace assembly.

The configuration of lower connection assembly 50 at the lower ends of the ladder sections to obtain a stepladder is illustrated in the elevation views of FIGS. 13 and 14. Elevation views of the other side of the stepladder are mirror images of the views shown. The following discussion of the side shown also applies to the opposite side, not shown. A first step in the conversion is to relocate the lower connector 15 from hole 52*a* of slide unit 52 to attach the slide unit 52 to the stop plate 54, as illustrated in FIG. 13. The second support brace 64 is also carried along with the lower connector to be rotateably attached to the lower stop plate. The connection assembly is now in a configuration to allow first and second side rails 20 and 40 to move apart from one another about the same hinge pin 38 (FIG. 12). The ladder sections are turned to a generally vertical position and displaced with respect to the one another in FIG. 14. Stationary foot pad 21 and adjustable foot pad 41 are placed on support surface 6 to stabilize the stepladder for use (FIG. 1B).

At the same time the ladder sections are separated at their lower ends, brace assembly 60 is released from its storage location along the side of the first side rail to rotate about brace pin 66. First and second braces 62 and 64 are connected at center pin 63 to rotate into a generally horizontal position between the lower support plate and the lower stop plate. The lower slide unit is carried along with the lower stop plate. The lower slide unit performs no function for the stepladder configuration and can alternately be removed. However, leaving the lower slide unit in place makes the lower connector along with the lower slide unit and the second support brace have a similar connection in both configurations.

Figure 15:
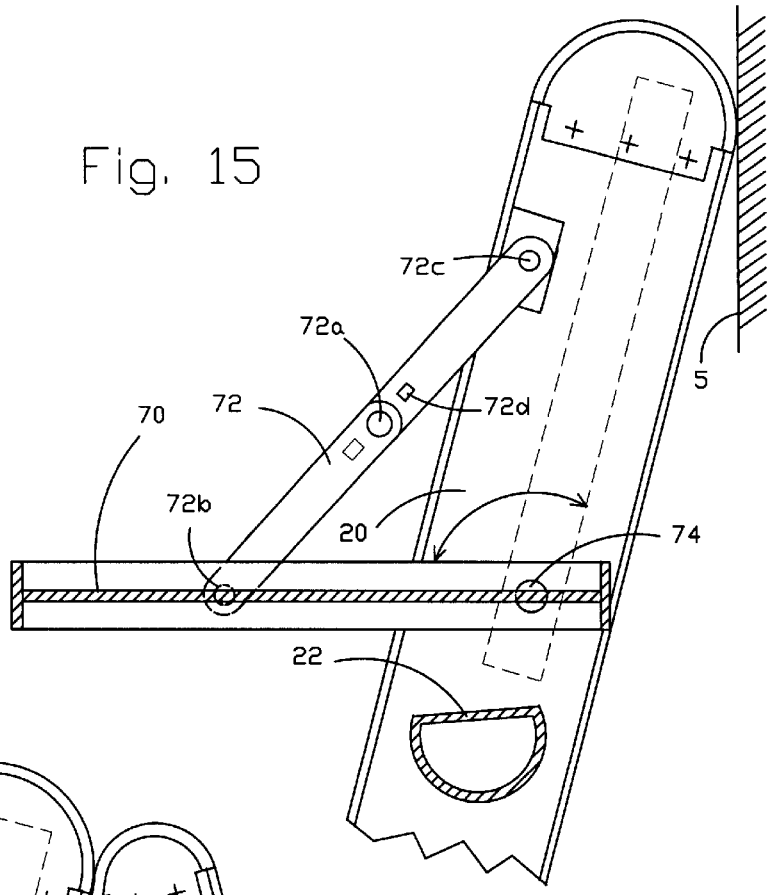
FIG. 15 is a cross sectional view of the upper end of the combination ladder illustrating the addition of a shelf for the extension ladder.
Figure 16:
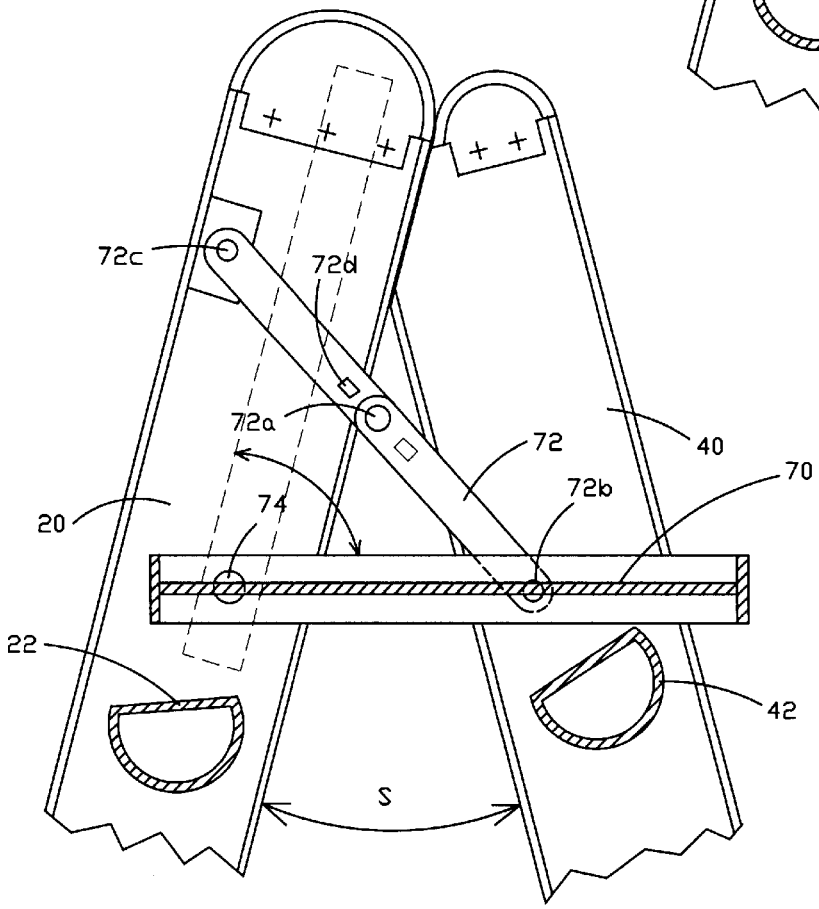
FIG. 16 is a cross sectional view of the upper end of the combination ladder illustrating the position of the shelf for the stepladder.

A single paint shelf can also be provided that works for both configurations of the combination ladder of this invention. A shelf 70 is added to the inside of the top ends of first side rails 20 of the first ladder section, as illustrated in the cross-sectional drawings of FIGS. 15 and 16. The shelf is attached on both sides to the first side rails by a shelf pin 74. A pair of shelf braces 72 each attach on a respective side of the shelf by a lower brace pin 72*b*. The shelf braces also attach to the first side rail by an upper brace pin 72*c*. The side braces each have a center brace pin so shelf brace can fold up and the shelf can be stored between the side rails, as illustrated by the dashed lines. A stop retainer bump 72*d* holds the shelf in the stored position. The shelf is rotated in one direction from the stored position about shelf pin 74 to provide the paint shelf for the extension ladder, as illustrated in FIG. 15. The shelf has been rotated to avoid any interference with the vertical support 5. The shelf is rotated in the other direction from the stored position about shelf pin 74 to provide the paint shelf for the stepladder, as illustrated in FIG. 16. The shelf has been rotated in this direction to provide the paint shelf in a location more central to the stepladder.

While a preferred embodiment of the invention has been described using specific terms, such description is for illustrative purposes only, and it is to be understood that changes and variations may be made without departing from the spirit or scope of the following claims.

What is claimed is:

1. A combination ladder having first and second conventional ladder sections each having upper and lower ends alternately connected together to provide a stepladder configuration or an extension ladder configuration, said combination ladder comprising:

a pair of upper connection assemblies for connecting the upper ends of the ladder sections together, each upper connection assembly including an upper slide unit, an upper support plate, an upper stop plate, a hinge pin and an upper connector for connecting said upper slide unit to either one of said upper support plate or said upper stop plate;

a pair of lower connection assemblies for connecting the lower ends of the ladder sections together, each lower connection assembly including a lower slide unit, a lower support plate, a lower stop plate and a lower connector for connecting said lower slide unit to either one of said lower support plate or said lower stop plate;

said upper and lower connectors having a first position for attaching both upper slide units to a respective upper support plate and both lower slide units to a respective lower support plate, wherein the first ladder section is free to move parallel to the second ladder section to provide the extension ladder configuration;

said upper and lower connectors having a second position for attaching both upper slide units to a respective upper stop plate and both lower slide units to a respective lower stop plate, wherein the upper end of the first ladder section is rotateably attached to the upper end of the second ladder section and the lower end of the first ladder section is free to move transverse to the lower end of the second ladder section to provide the stepladder configuration; and a pair of brace assemblies each connected to a respective one of said pair of lower connection assemblies for limiting the transverse distance between the lower ends of the ladder sections when providing the stepladder configuration.

2. The combination ladder of claim 1 wherein each one of said brace assemblies includes a first and a second support brace connected by a center pin.

3. The combination ladder of claim 2 wherein said first support brace is rotateably attached by a brace pin to said lower support plate and the second support plate is rotateably attached to said lower stop plate by said lower connector.

4. The combination ladder of claim 1 including a pair of brace assemblies, wherein each one of said brace assemblies is carried by the first ladder section when said brace assemblies are not in use for the configuration of the extension ladder.

5. The combination ladder of claim 4 including a brace clip for holding each one of said brace assemblies in place along the first ladder section.

6. The combination ladder of claim 1 wherein said upper slide unit of the upper connector assembly includes first and second connector plates and an upper slide plate affixed to both connector plates, wherein said upper connector attaches said second connector plate to said upper support plate and a hinge pin connects said first connector plate to said upper support plate so that the ladder sections are held adjacent to one another between the upper slide plate and said upper support plate for the configuration of the extension ladder.

7. The combination ladder of claim 6 wherein said lower slide unit of the lower connector assembly includes a lower connector plate and a lower slide plate affixed to said lower connector plate, wherein said lower connector attaches said lower connector plate to said lower support plate so that the ladder sections are held adjacent to one another between the lower slide plate and the lower support plate.

8. The combination ladder of claim 1 wherein said upper slide unit of the upper connector assembly includes first and second connector plates and an upper slide plate affixed to said connector plates, wherein said upper connector attaches said first connector plate to said upper stop plate and said hinge pin connects the first connector plate to said upper support plate so that the second ladder section can rotate about said hinge pin with respect to the first ladder section.

9. The combination ladder of claim 8 wherein said lower slide unit of the lower connector assembly includes a lower connector plate and a lower slide plate affixed to said lower connector plate, wherein said lower connector attaches said lower connector plate and said brace assembly to said lower stop plate so that the lower ends of the ladder sections can be separated but restrained by said brace assembly.

10. A ladder assembly for providing either one of a stepladder or an extension ladder, said ladder assembly comprising;

first and second conventional ladder sections each having a pair of side rails with upper and lower ends and evenly spaced apart rungs extending between said each pair of side rails;

a pair of upper connection assemblies associated with the upper ends of said side rails, said upper connection assemblies each having an upper slide unit for holding said side rails of said first and second ladder sections adjacent one to the other so that said first ladder section can be displaced relative to said second ladder section;

a pair of lower connection assemblies associated with the lower ends of said side rails, said lower connection assemblies each having a lower slide unit in combination with a pair of brace assemblies for holding said lower ends of said side rails of said ladder sections in a predetermined location one to the other; and a pair of upper connectors of said upper connection assemblies and a pair of lower connectors of said lower connection assemblies, wherein a first position of the connectors provides the extension ladder and a second position of the connectors provides the stepladder, wherein said upper connection assemblies each including an upper stop plate affixed to said upper end of said first ladder section and an upper support plate affixed to said upper end of said second ladder section, wherein said upper connectors is used to attach said slide unit to one of either the upper stop plate to provide the stepladder or the upper support plate to provide the extension ladder.

11. The combination ladder of claim 10 wherein each one of said brace assemblies includes first and second support braces, a brace pin and a center pin, wherein said braces are connected one to the other at a respective end by said center pin.

12. The combination ladder of claim 11 including a lower support plate and a lower stop plate, wherein the first support brace is rotateably attached at a free end by said brace pin to said lower support plate and said second support brace is rotateably attached at a free end by said lower connector to said lower stop plate to help provide the stepladder configuration.

13. The combination ladder of claim 10 wherein said lower connection assemblies each include an lower support plate affixed to said lower end of said first ladder section and a lower stop plate affixed to said lower end of said second ladder section, wherein said lower connector is used to attach said lower slide unit to one of either the lower stop plate to provide the stepladder or the lower support plate to provide the extension ladder.

14. The combination ladder of claim 10 including a shelf rotateably attach to said upper end of said first ladder section to be rotated in one direction for the stepladder and the other direction for the extension ladder.

15. A method for providing one of either a stepladder or an extension ladder, said method including the steps of:

a) providing first and second conventional ladder sections each having a pair of side rails with upper ends and lower ends;

b) placing said ladder sections adjacent one to the other so that said side rails are aligned with each other, one above the other;

c) providing a pair of upper connection assemblies associated with said upper ends of said ladder sections and a pair of lower connection assemblies associated with said lower ends of said ladder sections;

d) affixing a support plate of said upper connection assemblies to each one of said side rails at said upper end of said second ladder section and a support plate of said lower connection assemblies to each one of said side rails at said lower end of said first ladder section;

e) affixing a stop plate of said upper connection assemblies to each one of said side rails at said upper end of said first ladder section and a stop plate of said lower connection assemblies to each one of said side rails at said lower end of said second ladder section;

f) providing an upper slide unit and an upper connector for each one of said upper connection assemblies and a lower slide unit and a lower connector for each one of said lower connection assemblies; and g) connecting either one of said slide units to said stop plates using said connectors to provide the stepladder or said slide units to said support plates using said connectors to provide said extension ladder.

16. The method of claim 15 wherein the step of connecting said slide units to said stop plates using said connectors to provide the stepladder includes the steps of providing a pair of brace assemblies and connecting each one of said brace assemblies between the lower support plate and the lower stop plate.

17. The method of claim 15 including the step of rototeably attaching a shelf with a shelf brace to the upper end of said first ladder section between said pair of side rails and rotating said shelf to a horizontal position in one or either a rotational direction for the stepladder or in an opposite rotational direction for the extension ladder.

* * * * *